US012520924B2

(12) United States Patent
Times

(10) Patent No.: US 12,520,924 B2
(45) Date of Patent: Jan. 13, 2026

(54) FINGERNAIL SLEEVE DEVICE

(71) Applicant: Ernestine Times, Manvel, TX (US)

(72) Inventor: Ernestine Times, Manvel, TX (US)

( * ) Notice: Subject to any disclaimer, the term of this patent is extended or adjusted under 35 U.S.C. 154(b) by 404 days.

(21) Appl. No.: 17/690,316

(22) Filed: Mar. 9, 2022

(65) Prior Publication Data

US 2023/0284765 A1 Sep. 14, 2023

(51) Int. Cl.
*A45D 29/00* (2006.01)

(52) U.S. Cl.
CPC ..... *A45D 29/00* (2013.01); *A45D 2029/008* (2013.01)

(58) Field of Classification Search
CPC .... A45D 29/00; A45D 29/004; A45D 29/007; A45D 29/18; A45D 29/20; A45D 29/22; A45D 2029/008; A45D 31/00; A45D 2031/005
See application file for complete search history.

(56) References Cited

U.S. PATENT DOCUMENTS 2,251,551 A * 8/1941 O'Reilly ..... A45D 29/00 128/880
4,665,934 A 5/1987 Jefferson
4,694,843 A * 9/1987 Casenhiser ..... A45D 29/00 2/21
5,026,541 A * 6/1991 Lanier ..... A45D 29/007 132/73
5,699,816 A * 12/1997 Banes ..... A45D 29/00 132/73
5,761,743 A * 6/1998 Andrews ..... A61B 42/00 2/21
6,302,116 B1 10/2001 Copeland
6,634,367 B2 10/2003 Abraham
D516,750 S 3/2006 Kazumura
8,499,771 B1 8/2013 Auda
9,439,461 B1 * 9/2016 Hall ..... A63B 71/14
2003/0178041 A1 * 9/2003 Abraham ..... A45D 29/004 132/76.4
2013/0014308 A1 1/2013 Feliciano
2014/0007894 A1 * 1/2014 Gagnon ..... A45D 29/00 132/200

(Continued)

FOREIGN PATENT DOCUMENTS

CA 1277886 12/1990
JP 2001070037 A * 3/2001

OTHER PUBLICATIONS

JP2001070037A. Translation (Year: 2001).*

*Primary Examiner* — Rachel R Steitz
*Assistant Examiner* — Karim Asqiriba

(57) ABSTRACT

A fingernail sleeve device for enwrapping both the finger and the elongated decorated fingernail includes an opening. The opening is circular and is coupled to a surface. The surface has a finger side and a nail side and enwraps the end of a finger. The nail side is positioned upon the fingernail of the finger, and the finger side is positioned against the skin. A cavity protrudes out from an end of the surface and has a downward curvature. An elongated decorated fingernail is nested within the cavity. The cavity defines an enclosed space for the fingernail. The cavity and the nail side of the surface have a hard material to protect the fingernail within the fingernail sleeve device. The soft material facilitates the application of the fingernail sleeve device to the finger.

10 Claims, 5 Drawing Sheets

(56) References Cited

U.S. PATENT DOCUMENTS

| | | | | |
|---|---|---|---|---|
| 2015/0013709 | A1* | 1/2015 | Scheurn | A45D 29/18<br>132/73 |
| 2017/0224082 | A1* | 8/2017 | Pimentel | A45D 29/00 |
| 2022/0015521 | A1* | 1/2022 | Wilson-Brooks | A45D 29/007 |

* cited by examiner

FINGERNAIL SLEEVE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fingernail protective covers and more particularly pertains to a new fingernail protective cover for enwrapping both the finger and the elongated decorated fingernail.

(2) Description of Related Art Including Information Disclosed Under 37 CFR 1.97 and 1.98

The prior art relates to fingernail protective covers. The prior art includes a variety of fingernail protective covers designed to covering a variety of fingernail lengths. Furthermore, the prior art includes a variety of fingernail protective covers having a durable material to provide protection. Known prior art lacks a fingernail protective cover having an elastomeric material to enwrap the end of a finger and a cavity having a durable material designed to accommodate an elongated decorative nail.

BRIEF SUMMARY OF THE INVENTION

An embodiment of the disclosure meets the needs presented above by generally comprising an opening. The opening has a perimeter. The perimeter is configured for being a range of sizes for a finger of a user. A surface is coupled to the perimeter of the opening and protruding out therefrom. The surface has a nail side and a finger side. The nail side is configured for being positioned upon a finger nail. The surface is configured for enwrapping the end of the finger of the user. A cavity is positioned on an end of the surface. The cavity is an enclosed space. The enclosed space defines a space for the nail of a finger to be positioned within.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
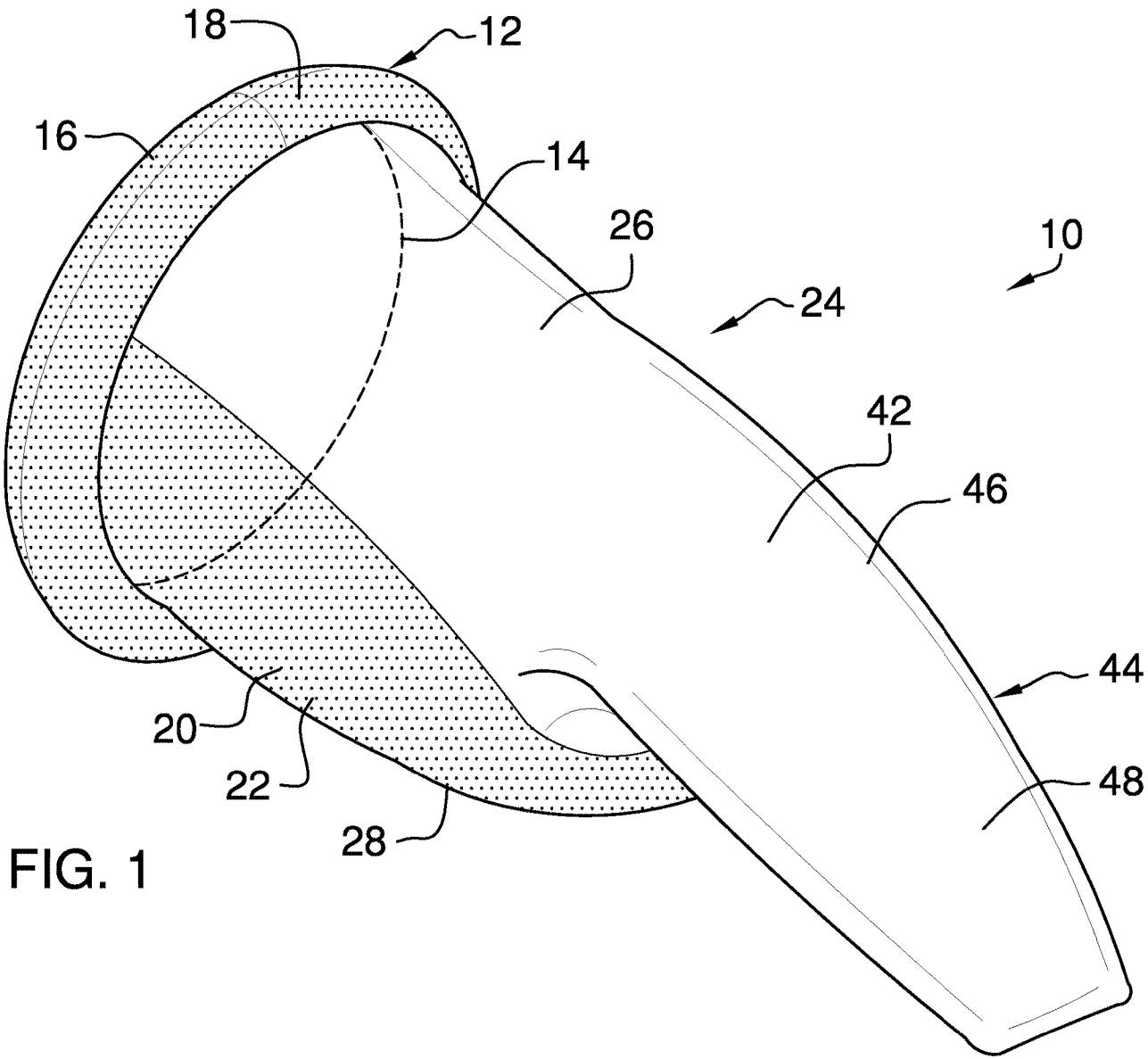
FIG. 1 is an isometric view of a fingernail sleeve device according to an embodiment of the disclosure.
Figure 2:
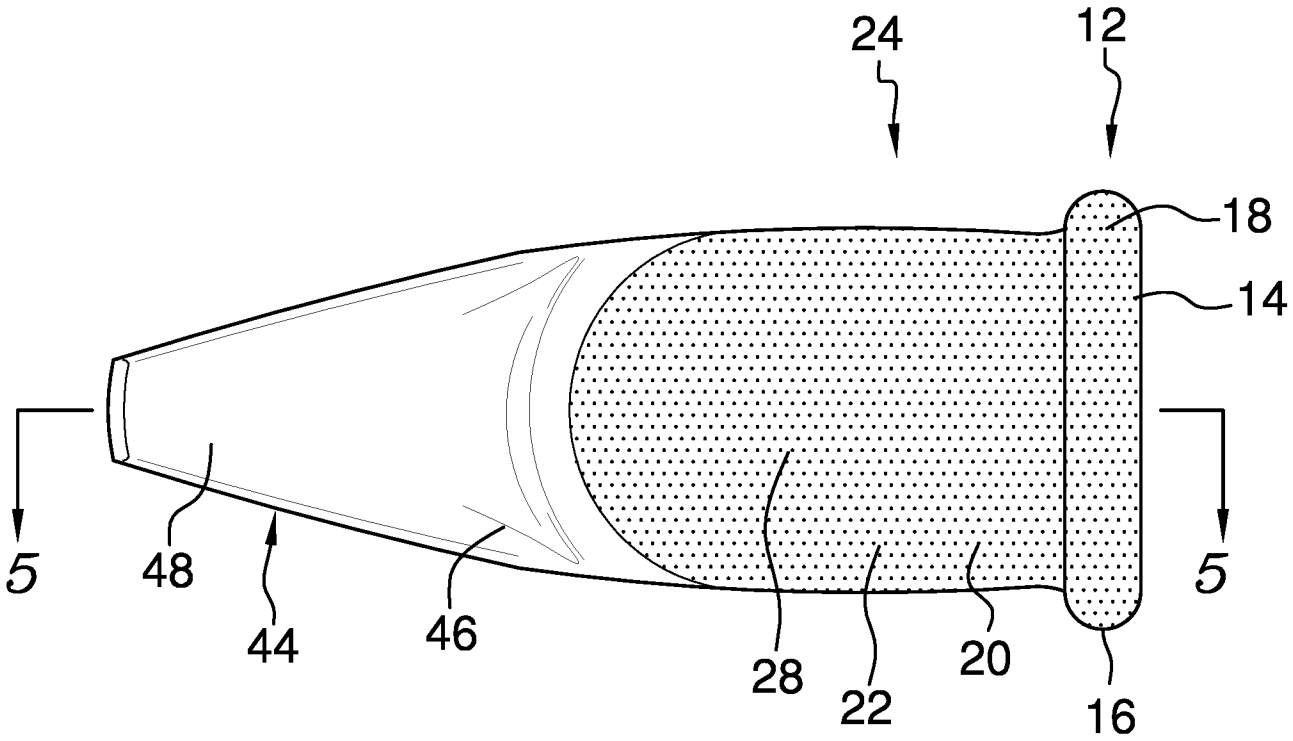
FIG. 2 is a bottom view of an embodiment of the disclosure.
Figure 3:
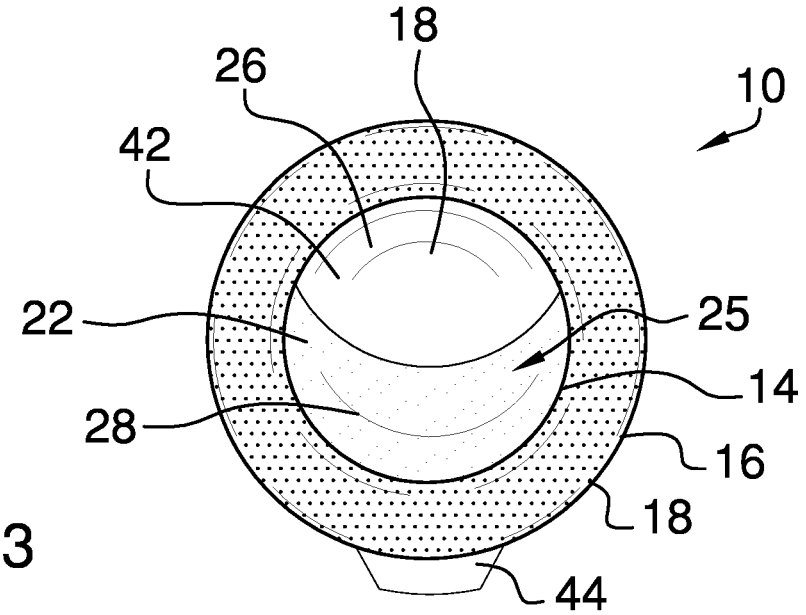
FIG. 3 is a back view of an embodiment of the disclosure.
Figure 4:
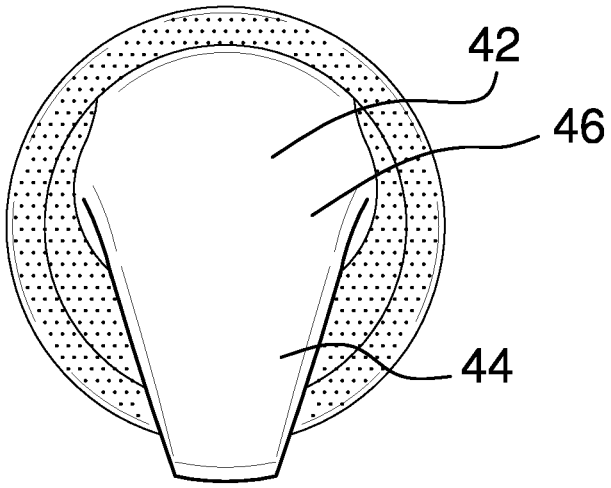
FIG. 4 is a front view of an embodiment of the disclosure.
Figure 5:
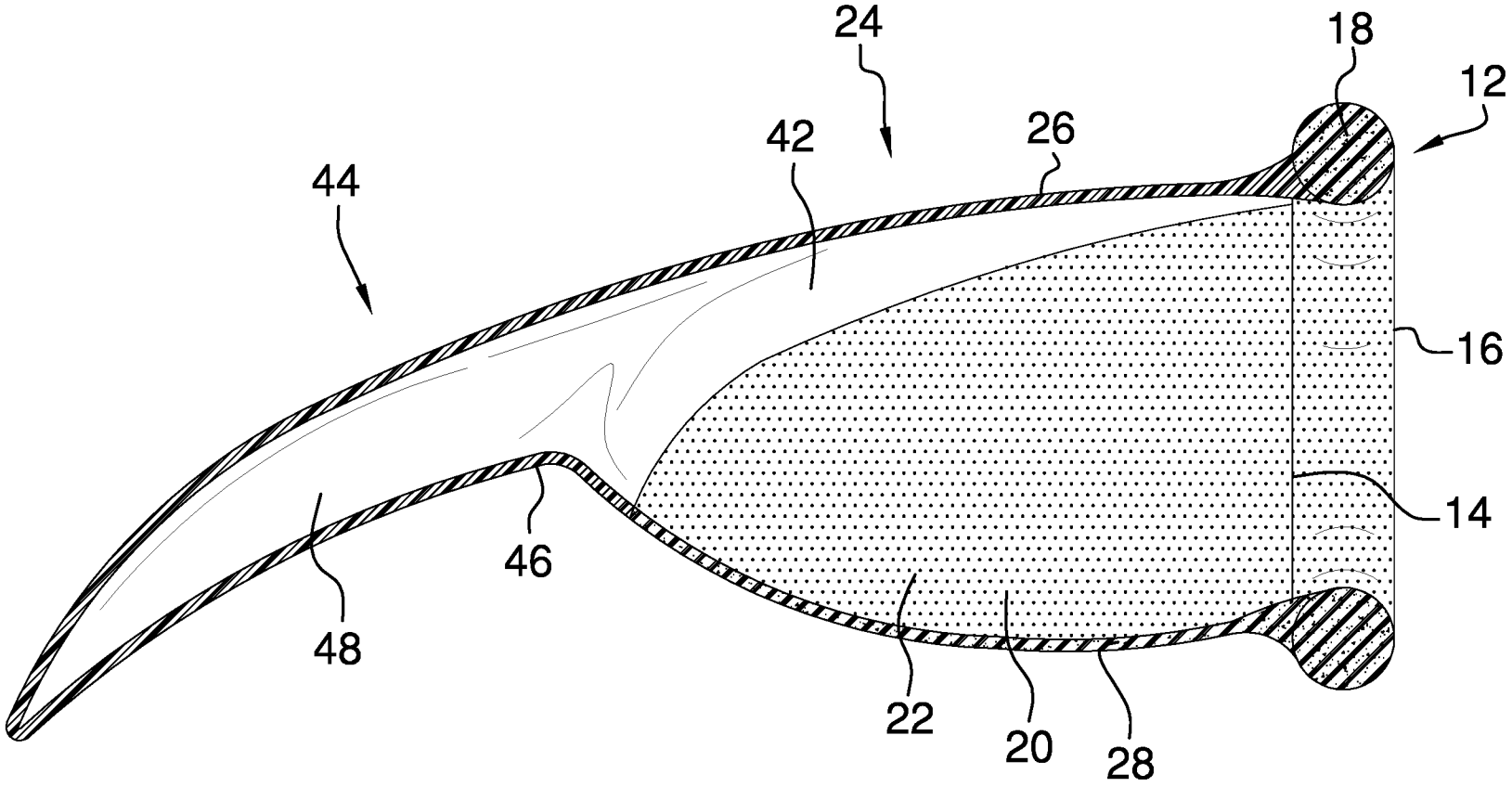
FIG. 5 is a cross-section view of an embodiment of the disclosure taken from FIG. 2 of Line 5-5.
Figure 6:
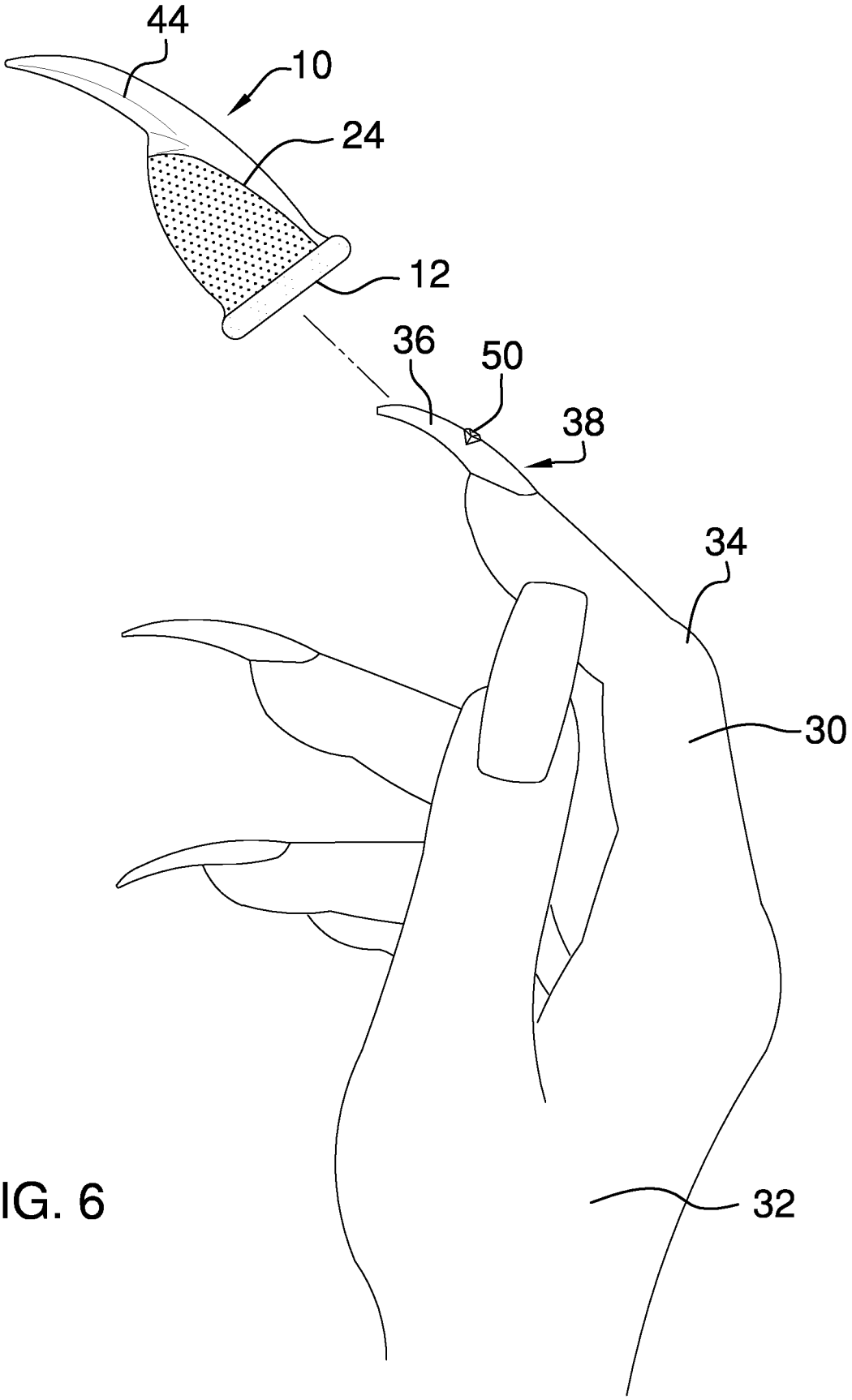
FIG. 6 is an in-use view of an embodiment of the disclosure.

With reference now to the drawings, and in particular to FIGS. 1 through 6 thereof, a new fingernail protective cover embodying the principles and concepts of an embodiment of the disclosure and generally designated by the reference numeral 10 will be described.

As best illustrated in FIGS. 1 through 6, the fingernail sleeve device 10 generally comprises an opening 12. The opening 12 is circular 14 and has a perimeter 16. The perimeter 16 is configured for being a range of sizes for a finger 30 of a user 32. The perimeter 16 has a tubular shape 18. The opening 12 is a soft material 20 whereby the soft material 20 is an elastomeric material 22 such as microfiber. The soft material 20 is comfortable for the finger 30 of the user 32. The soft material 20 is configured for facilitating the application of the fingernail sleeve device 10.

A surface 24 is coupled to the perimeter 16 of the opening 12 and protrudes out therefrom. The surface 24 has an interior 25 that defines a space for the finger 30 of the user 32 to be inserted within. The surface 24 is configured for enwrapping the end 15 of the finger 30 of the user 32 to the first knuckle 34 of the finger 30. The surface 24 has a nail side 26 and a finger side 28. The nail side 26 and the finger side 28 are parallel to each other. The nail side 26 is configured for be positioned upon the fingernail 38 of the user 32, thus the finger side 28 is positioned on the skin 40 of the finger 30. The finger side 28 of the surface 24 has the soft material 20, where the nail side 26 has a hard material 42. The hard material 42 is a durable material such as a thermoset polymer. The hard material retains its shape continuously.

A cavity 44 is positioned on an end 46 of the surface 24. The cavity 44 is coplanar with the nail side 26, thus being parallel with the finger side 28. The cavity 44 is an enclosed space 48 that defines a space for the fingernail 38 to be positioned within. The cavity 44 is made of the hard material 42 whereby providing protection to the fingernail 38. The cavity 44 has a fingernail shape being configured for accommodating the shape of an elongated decorated fingernail 36. The elongated decorated fingernail 36 has extends outward from the finger 30 and has a downward curvature. Furthermore, the elongated decorated fingernail 36 can comprise a variety of designs and elements such as a gem 50. The purpose of the cavity 44 is for enclosing the elongated decorated fingernail 36 inserted within the enclosed space 48 of the cavity 44.

In use, the finger 30 of the user 32 is inserted through the opening 12 into the interior 25 of the surface 24. The finger side 28 of the surface 24 would be positioned against the skin 40 of the finger 30, thus the nail side 26 of the surface 24 being positioned upon the fingernail 38. The elongated decorated fingernail 36 of the finger 30 is nested within the enclosed space 48 of the cavity 44. The hard surface 42 is configured to protect the elongated decorated fingernail 36 from the outside environment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fingernail sleeve device comprising: an opening, said opening having a perimeter, said perimeter being configured for being a range of size for a finger of a user; a surface, said surface being positioned on said perimeter of said opening and protruding out therefrom, said surface having a nail side and a finger side, said nail side being configured for being positioned upon a finger nail, said surface being configured for enwrapping an end of the finger of the user; a cavity, said cavity being positioned on an end of said surface, said cavity being an enclosed space, said enclosed space defining a space being configured for the nail of a finger to be positioned within, said cavity being defined by an upper portion having a convex outer face extending from the nail side and a lower portion having a concave outer face extending from the finger side.

2. The fingernail sleeve device of claim 1, further comprising said opening being circular.

3. The fingernail sleeve device of claim 1, further comprising said opening being an elastomeric material.

4. The fingernail sleeve device of claim 1, further comprising said nail side and said finger side being parallel relative to each other.

5. The fingernail sleeve device of claim 1, further comprising said finger side being configured for being positioned upon a skin of the finger of the user.

6. The fingernail sleeve device of claim 1, further comprising said nail side being a thermoset polymer.

7. The fingernail sleeve device of claim 1, further comprising said cavity being coplanar to said nail side of said surface.

8. The fingernail sleeve device of claim 1, further comprising said cavity having a fingernail shape, said fingernail shape being configured for accommodating the shape of an elongated decorated fingernail.

9. The fingernail sleeve device of claim 1, further comprising said cavity being configured for enclosing the elongated decorated fingernail inserted within said enclosed space of said cavity.

10. A fingernail sleeve device comprising:

an opening, said opening being circular, said opening having a perimeter, said perimeter being configured for being a range of size for a finger of a user, said opening being an elastomeric material;

a surface, said surface being positioned on said perimeter of said opening and protruding out therefrom, said surface having a nail side and a finger side, said nail side and said finger side being parallel relative to each other, said nail side being configured for being positioned upon a fingernail, said finger side being configured for being positioned upon a skin of the finger of the user, said finger side being said elastomeric material, said nail side being a thermoset polymer, said surface being configured for enwrapping an end of the finger of the user;

a cavity, said cavity being positioned on an end of said surface, said cavity being an enclosed space, said enclosed space defining a space being configured for the nail of a finger to be positioned within, said cavity being defined by an upper portion having a convex outer face extending from the nail side and a lower portion having a concave outer face extending from the finger side, said cavity being coplanar to said nail side of said surface, said cavity having a fingernail shape, said fingernail shape being configured for accommodating a shape of an elongated decorated fingernail, said cavity being configured for enclosing the elongated decorated fingernail inserted within said enclosed space of said cavity, said cavity being said thermoset polymer.

* * * * *